US009556759B2

(12) United States Patent
Otsubo et al.

(10) Patent No.: US 9,556,759 B2
(45) Date of Patent: Jan. 31, 2017

(54) VALVE TIMING CONTROLLER

(71) Applicants: DENSO CORPORATION, Kariya, Aichi-pref. (JP); NIPPON SOKEN, INC., Nishio, Aichi-pref. (JP)

(72) Inventors: Makoto Otsubo, Okazaki (JP); Hiroki Takahashi, Okazaki (JP); Masaya Misaki, Kariya (JP)

(73) Assignees: DENSO CORPORATION, Kariya (JP); NIPPON SOKEN, INC., Nishio (JP)

( * ) Notice: Subject to any disclaimer, the term of this patent is extended or adjusted under 35 U.S.C. 154(b) by 0 days.

(21) Appl. No.: 14/881,456

(22) Filed: Oct. 13, 2015

(65) Prior Publication Data

US 2016/0123197 A1 May 5, 2016

(30) Foreign Application Priority Data

Oct. 13, 2014 (JP) ..... 2014-209565

(51) Int. Cl.

| | |
|---|---|
| ***F01L 1/34*** | (2006.01) |
| ***F01L 1/352*** | (2006.01) |
| ***F01M 9/10*** | (2006.01) |
| *F01L 1/344* | (2006.01) |

(52) U.S. Cl.

CPC ..... *F01L 1/352* (2013.01); *F01M 9/10* (2013.01); *F01L 1/344* (2013.01)

(58) Field of Classification Search

CPC ..... F01L 1/344; F01L 1/352; F01M 9/10
USPC ..... 123/90.15, 90.17, 90.33
See application file for complete search history.

(56) References Cited

U.S. PATENT DOCUMENTS 8,251,029 B2 * 8/2012 Kurisu ..... F01L 1/352 123/90.15
2010/0180845 A1 7/2010 Kurisu et al.

FOREIGN PATENT DOCUMENTS

JP 2013-147983 8/2013

* cited by examiner

*Primary Examiner* — Ching Chang
(74) *Attorney, Agent, or Firm* — Nixon & Vanderhye PC

(57) ABSTRACT

A valve timing controller has a driving rotor, a driven rotor, and a planet gear engaged with the driving rotor and the driven rotor to control a rotation phase of the driven rotor relative to the driving rotor by carrying out planet movement. The driven rotor has a contact surface in contact with a tip end of a chamfering portion of a camshaft, and a feed port passing through the driven rotor in an axial direction to introduce lubricant supplied from the camshaft into the driving rotor. The feed port has an outer edge part located on a radially outer side. The outer edge part, on a side adjacent to the contact surface, is located on a radially outer side of the tip end of the chamfering portion and is located on a radially inner side of an outer circumference part of the journal portion.

9 Claims, 9 Drawing Sheets

VALVE TIMING CONTROLLER

CROSS REFERENCE TO RELATED APPLICATION

This application is based on Japanese Patent Application No. 2014-209565 filed on Oct. 13, 2014, the disclosure of which is incorporated herein by reference in its entirety.

TECHNICAL FIELD

The present disclosure relates to a valve timing controller.

BACKGROUND

A valve timing controller is attached to an internal combustion engine to control a valve timing of valve opened and closed by a camshaft. JP 5240309 B2 (US 2010/0180845 A1) describes a valve timing controller equipped with a driving rotor supported by a journal portion from a radially inner side to rotate with a crankshaft, a driven rotor rotating with a camshaft inside of the driving rotor, and a planet gear engaged with the driving rotor and the driven rotor to control a rotation phase of the driven rotor relative to the driving rotor by carrying out planet movement. The driven rotor has a contact surface in contact with a tip end of a chamfering portion, and a feed port passing through the driven rotor in an axial direction to introduce lubricant supplied from the camshaft into the driving rotor.

In the contact surface of the driven rotor in contact with the camshaft, the outer edge part of the feed port is located at the radially same position as the outer circumference part of the journal portion, or is positioned on the radially outer side of the outer circumference part. In these cases, the lubricant lubricating the interface of the journal portion may decrease.

The camshaft may have a chamfering portion at which the diameter is decreased as extending from the journal portion toward the tip end, in consideration of the workability and safety for a worker at the assembling time. However, at the feed port, if the outer edge part of the chamfering portion is located on the radially inner side of the tip end of the camshaft, introduction of the lubricant may be affected.

SUMMARY

It is an object of the present disclosure to provide a valve timing controller in which lubricant easily lubricates various parts.

According to an aspect of the present disclosure, for an internal combustion engine having a camshaft with a journal portion and a chamfering portion, a valve timing controller includes a driving rotor, a driven rotor and a planet gear, and controls valve timing of a valve opened and closed by the camshaft using a torque transferred from a crankshaft. A diameter of the chamfering portion decreases as extending from the journal portion toward a tip end of the camshaft. The driving rotor is supported by the journal portion from a radially inner side to rotate with the crankshaft. The driven rotor rotates with the camshaft inside of the driving rotor. The planet gear is engaged with the driving rotor and the driven rotor to control a rotation phase of the driven rotor relative to the driving rotor by carrying out planet movement. The driven rotor has a contact surface in contact with a tip end of the chamfering portion, and a feed port passing through the driven rotor in an axial direction to introduce lubricant supplied from the camshaft into the driving rotor.

The feed port has an outer edge part located on a radially outer side. The outer edge part, on a side adjacent to the contact surface, is located on a radially outer side of the tip end of the chamfering portion and is located on a radially inner side of an outer circumference part of the journal portion.

Accordingly, the lubricant supplied from the camshaft is introduced into the driving rotor from the feed port. The outer edge part of the feed port is at least located on the outer side of the tip end of the chamfering portion in the radial direction, so lubricant easily and smoothly infiltrates into the interface of the contact surface and the journal portion. Moreover, the outer edge part of the feed port is located on the inner side of the outer circumference part of the journal portion in the radial direction, so lubricant further easily infiltrates into the interface of the journal portion by centrifugal force. Thus, lubricant easily lubricates various parts in the valve timing controller.

According to an aspect of the present disclosure, for an internal combustion engine having a camshaft with a journal portion and a chamfering portion, a valve timing controller includes a driving rotor, a driven rotor and a planet gear, and controls valve timing of a valve opened and closed by the camshaft using a torque transferred from a crankshaft. A diameter of the chamfering portion decreases as extending from the journal portion toward a tip end of the camshaft. The driving rotor is supported by the journal portion from a radially inner side to rotate with the crankshaft. The driven rotor rotates with the camshaft inside of the driving rotor. The planet gear is engaged with the driving rotor and the driven rotor to control a rotation phase of the driven rotor relative to the driving rotor by carrying out planet movement. The driven rotor has a contact surface in contact with a tip end of the chamfering portion, and a feed port passing through the driven rotor in an axial direction to introduce lubricant supplied from the camshaft into the driving rotor. The feed port has an outer edge part located on a radially outer side. A diameter of the outer edge part is smaller on an opposite side opposite from the contact surface in contact with the camshaft than that on the contact surface. The outer edge part, on the opposite side, is located on a radially inner side of an outer circumference part of the journal portion. The outer edge part, on the contact surface, is located on a radially outer side of a tip end of the chamfering portion.

Accordingly, the lubricant supplied from the camshaft is introduced into the driving rotor from the feed port. The outer edge part of the feed port on the opposite side of the camshaft opposite from the contact surface is at least located on the radially inner side of the outer circumference part of the journal portion, so lubricant easily infiltrates into the interface of the journal portion by centrifugal force. The outer edge part on the contact surface is located on the radially outer side of the tip end of the camshaft, so lubricant easily and smoothly infiltrates into the interface of the contact surface and the journal portion. Thus, lubricant easily lubricates various parts in the valve timing controller.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
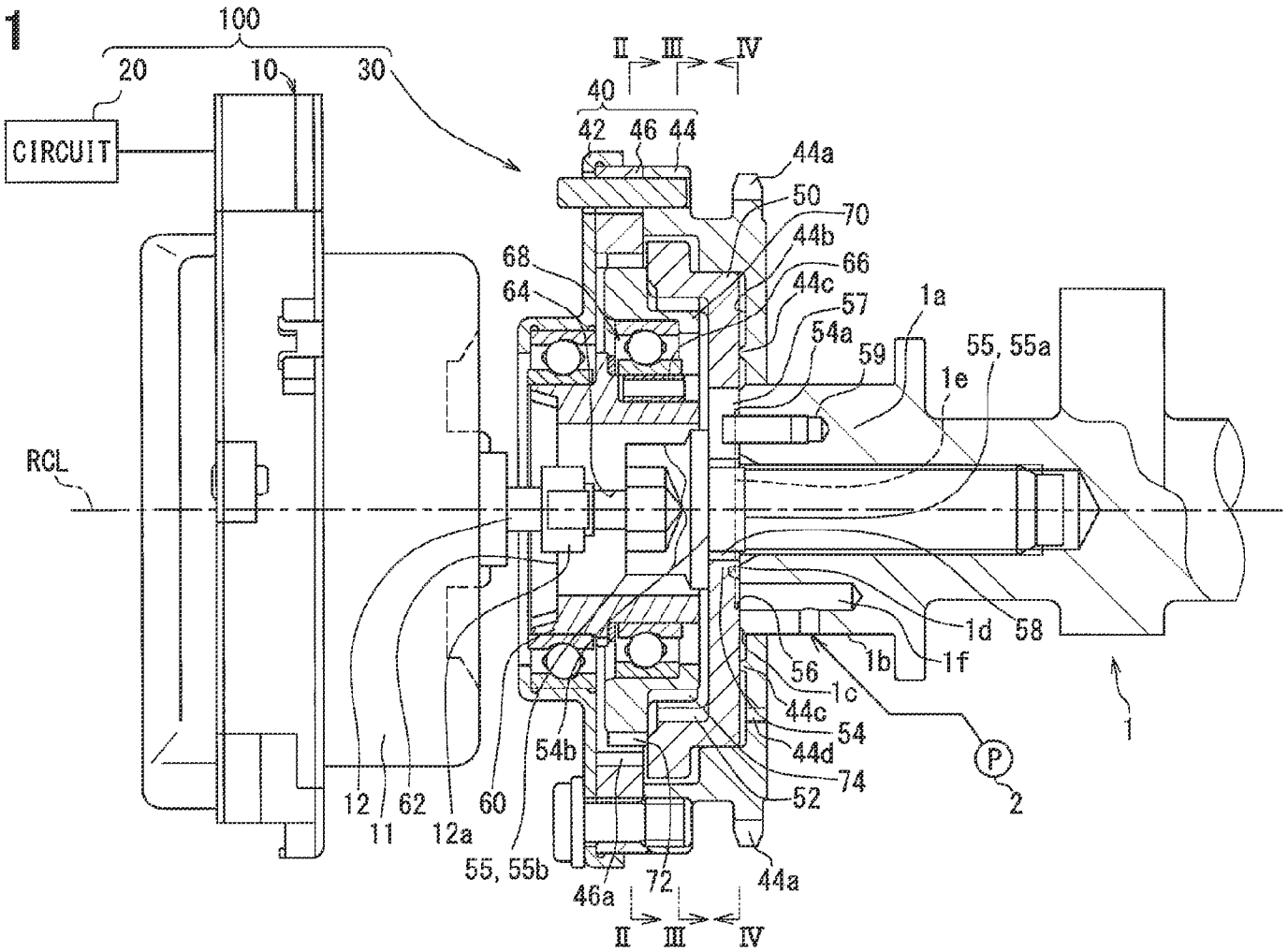
FIG. 1 is a schematic view illustrating a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 2:
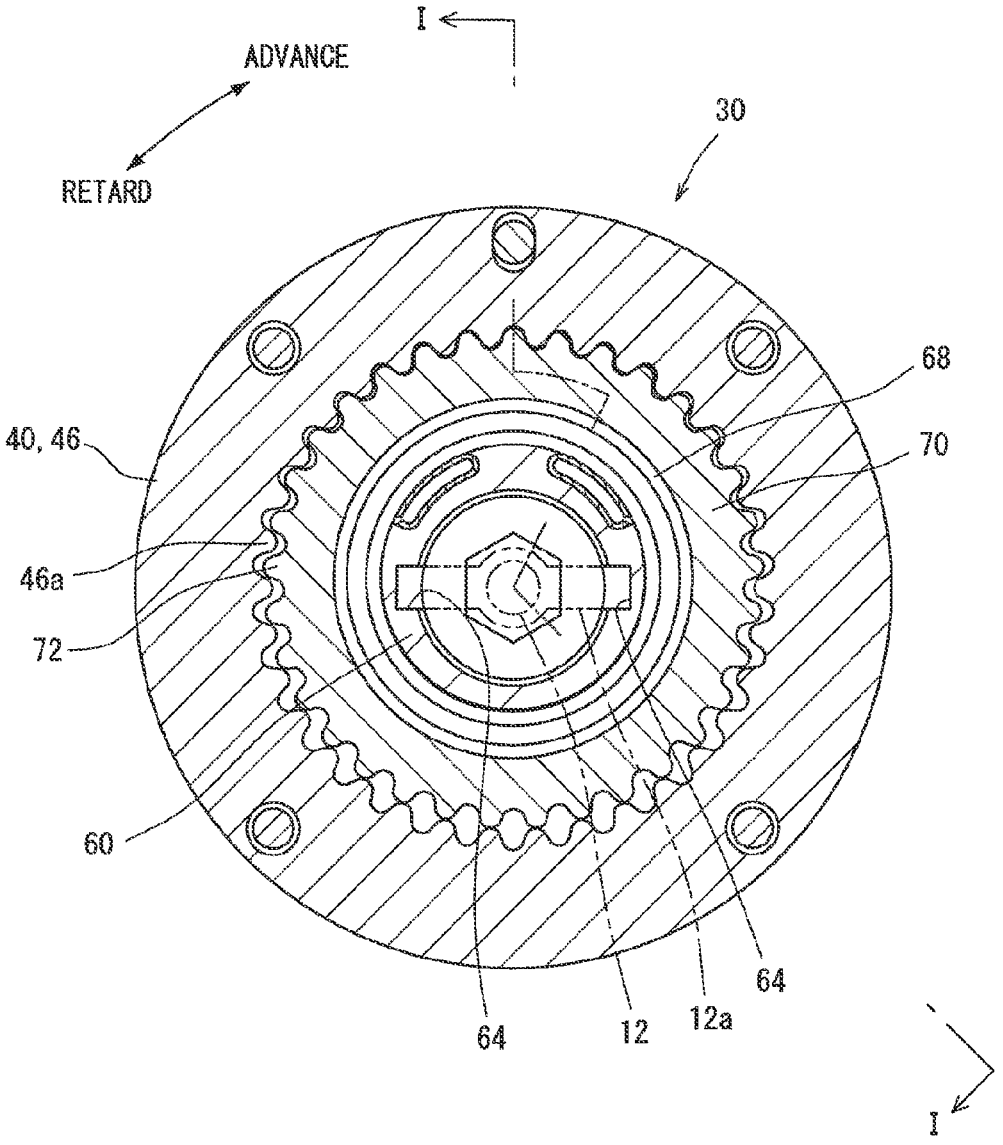
FIG. 2 is a sectional view taken along a line II-II of FIG. 1.

A valve timing controller 100 according to a first embodiment is shown in FIG. 1 that is a cross-sectional view taken along a line I-I in FIG. 2, and is mounted for an internal combustion engine on a vehicle. The valve timing controller 100 is installed in a transfer system in which a crank torque is transferred to a camshaft 1 from a crankshaft (not shown) of the internal combustion engine.

The camshaft 1 opens and closes an intake valve of the internal combustion engine by torque transfer, and controls the intake valve to have a suitable valve timing. The camshaft 1 has a journal portion 1*a* and a chamfering portion 1*c*. A diameter of the chamfering portion 1*c* decreases from the journal portion 1*a* to a tip end 1*d* of the camshaft 1. An outer circumference part 1*b* of the camshaft 1 has a cylindrical shape at the journal portion 1*a*, and has a cone shape at the chamfering portion 1*c*.

The valve timing controller 100 includes an actuator 10, a power control circuit 20, and a phase controlling mechanism 30.

The actuator 10 is an electric motor such as brushless motor, and has a case 11 and a control shaft 12. The case 11 is fixed to a fix portion of the internal combustion engine, and the control shaft 12 is supported by the case 11 to be able to rotate in both a right direction and a reverse direction.

The power control circuit 20 has a driver, and a microcomputer for controlling the driver, and is arranged outside and/or inside the case 11 and electrically connected with the actuator 10. The power control circuit 20 supplies electricity to the actuator 10 so as to adjust the valve timing according to the operational status of the internal combustion engine, such that the rotation state of the control shaft 12 is controlled.

The phase controlling mechanism 30 has a driving rotor 40, a driven rotor 50, a planet carrier 60, and a planet gear 70.

Figure 3:
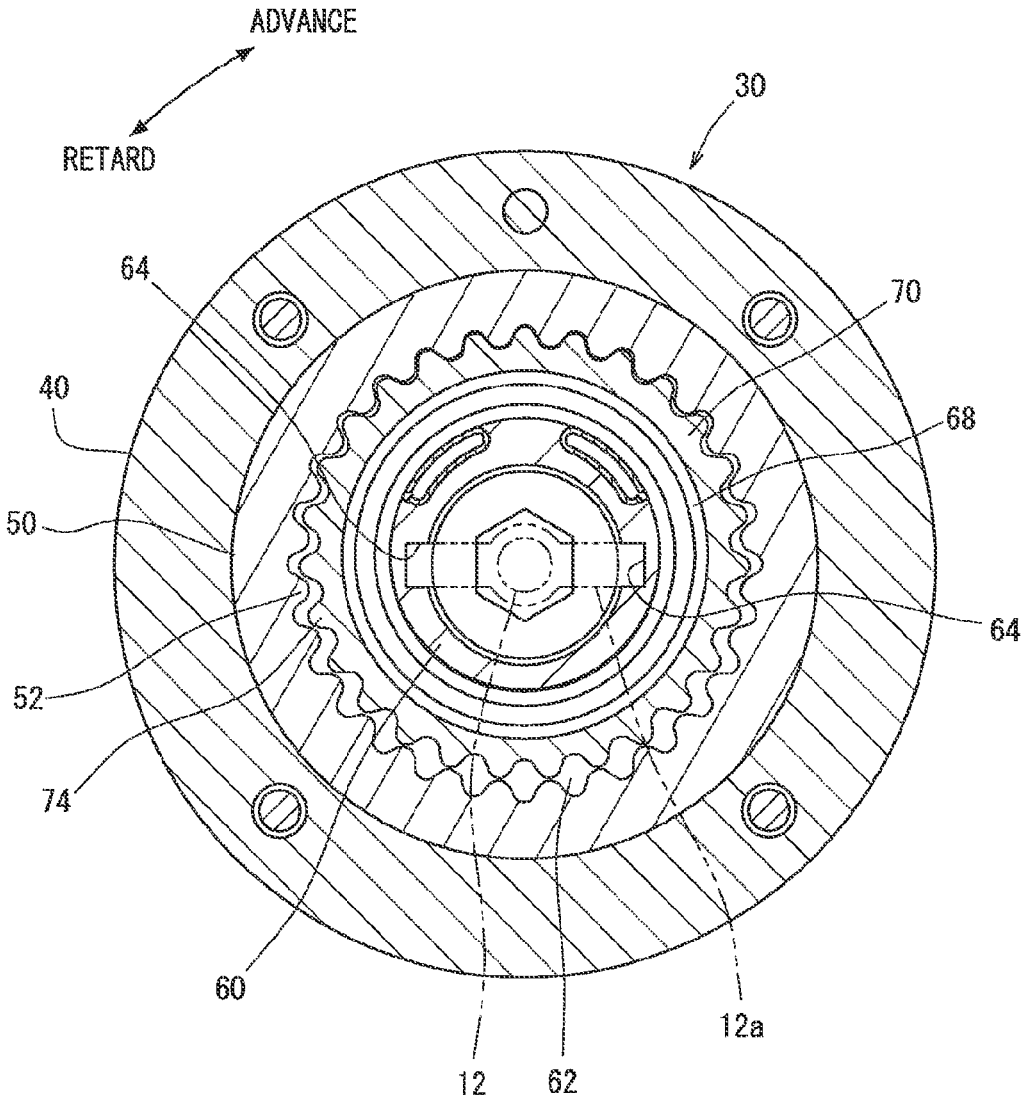
FIG. 3 is a sectional view taken along a line III-III of FIG. 1.

As shown in FIGS. 1-3, the driving rotor 40 has a cylindrical shape as a whole, and receives the driven rotor 50, the planet carrier 60, and the planet gear 70 of the phase controlling mechanism 30 therein. The driving rotor 40 has a gear component 46 between a cover component 42 and a sprocket component 44, which are coaxially tightened together.

As shown in FIGS. 1 and 2, the gear component 46 has a round wall shape, and the peripheral wall part of the gear component 46 has a drive side annular-gear part 46*a* with a tip circle smaller than a root circle. As shown in FIGS. 1 and 3, the sprocket component 44 has a stepped cylindrical shape, and the peripheral wall part of the sprocket component 44 has plural teeth 44*a* arranged in a circumference direction. The teeth 44*a* protrude from the peripheral wall part outward in the radial direction. A timing chain (not shown) is engaged between the teeth 44*a* of the sprocket component 44 and teeth of the crankshaft, such that the sprocket component 44 is linked with the crankshaft. When the crank torque output from the crankshaft is transmitted to the sprocket component 44 through the timing chain, the driving rotor 40 rotates with the crankshaft. At this time, the driving rotor 40 is rotated in a clockwise rotation shown in FIG. 2 and FIG. 3.

As shown in FIGS. 1 and 3, the driven rotor 50 has a based cylindrical shape, and is coaxially arranged in the sprocket component 44. The diameter of the sprocket component 44 is larger than that of the driver rotor 50. The driven rotor 50 has a fastening part 54 on the bottom wall part, and the fastening part 54 is coaxially fixed to the camshaft 1. The driven rotor 50 is rotatable relative to the driving rotor 40, while rotating with the camshaft 1. The driven rotor 50 is set to rotate in the clockwise rotation in FIG. 3, similarly to the driving rotor 40.

The peripheral wall part of the driven rotor 50 has a driven side annular-gear part 52 with a tip circle smaller than a root circle. The inside diameter of the driven side annular-gear part 52 is set smaller than the inside diameter of the drive side annular-gear part 46*a*, and the number of teeth of the driven side annular-gear part 52 is set fewer than the number of teeth of the drive side annular-gear part 46*a*. The driven side annular-gear part 52 is located between the drive side annular-gear part 46*a* and the camshaft 1 in the axial direction.

As shown in FIGS. 1-3, the planet carrier 60 has a cylindrical shape as a whole, and has a connection part 62 on the inner circumference surface of the peripheral wall part. The connection part 62 has a cylindrical surface shape coaxially with the driving rotor 40, the driven rotor 50 and the control shaft 12. The connection part 62 has a fitting slot 64 fitted with a joint part 12*a* of the control shaft 12. The planet carrier 60 is rotatable relative to the drive side annular-gear part 46*a*, while rotating integrally with the control shaft 12.

As shown in FIGS. 1-3, the planet carrier 60 has a support part 66 on the outer circumference surface of the peripheral wall part. The support part 66 has a cylindrical surface shape eccentric to the driving rotor 40, the driven rotor 50 and the control shaft 12. A rolling bearing 68 is interposed between the support part 66 and the planet gear 70 in the radial direction, and the support part 66 supports the planet gear 70 through the rolling bearing 68 such that the planet gear 70 is able to have the planet movement. The planet gear 70 is coaxially arranged on the radially outer side of the support part 66. The planet movement means that the planet gear 70 rotates on the eccentric axis of the support part 66 having the cylindrical surface shape, and revolves in the rotating direction of the planet carrier 60.

The planet gear 70 has a stepped cylindrical shape as a whole, and the peripheral wall part has a drive side external-gear part 72 and a driven side external-gear part 74, with a tip circle larger than a root circle. The drive side external-gear part 72 is arranged in the drive side annular-gear part 46*a*, and geared with the drive side annular-gear part 46*a*.

In contrast, the driven side external-gear part 74 located between the drive side external-gear part 72 and the fastening part 54 is arranged in the driven side annular-gear part 52, and geared with the driven side annular-gear part 52. The outer diameter of the driven side external-gear part 74 is set smaller than the outer diameter of the drive side external-gear part 72. The number of teeth of the driven side external-gear part 74 and the drive side external-gear part 72 is set smaller respectively than the number of teeth of the driven side annular-gear part 52 and the drive side annular-gear part 46*a* by the same number.

Thus, the phase controlling mechanism 30 has the planet gear 70 engaged between the driving rotor 40 and the driven rotor 50, and converts the rotational movement of the planet carrier 60 according to the rotation state of the control shaft 12 into the planet movement of the planet gear 70. Therefore, the rotation phase of the driven rotor 50 relative to the driving rotor 40 is controlled to set the valve timing.

Specifically, when the control shaft 12 rotates at the same speed with the driving rotor 40, the planet carrier 60 does not have relative rotation relative to the drive side annular-gear part 46*a*. Therefore, the external-gear part 72, 74 of the planet gear 70 engaged with the annular-gear parts 46*a*, 52 has no planet movement, and rotates with the rotors 40 and 50. As a result, since the rotation phase does not change, the valve timing is held at this time.

When the control shaft 12 rotates at a speed higher than the driving rotor 40, the planet carrier 60 has relative rotation on the advance side relative to the drive side annular-gear part 46*a*. The external-gear part 72, 74 of the planet gear 70 integrally has planet movement while meshing with the annular-gear part 46*a*, 52. As a result, since the driven rotor 50 carries out relative rotation on the advance side relative to the driving rotor 40, and the rotation phase changes on the advance side, such that the valve timing is advanced at this time.

When the control shaft 12 rotates at a speed lower than the driving rotor 40 or rotates in the reverse direction relative to the driving rotor 40, the planet carrier 60 has relative rotation relative to the drive side annular-gear part 46*a*. The external-gear part 72, 74 of the planet gear 70 integrally has planet movement while meshing with the annular-gear part 46*a*, 52. As a result, since the driven rotor 50 carries out relative rotation on the retard side relative to the driving rotor 40, and the rotation phase changes on the retard side, such that the valve timing is retarded at this time.

As shown in FIG. 1, the sprocket component 44 of the driving rotor 40 is coaxially fitting to the outer circumference part 1*b* of the journal portion 1*a* of the camshaft 1. The sprocket component 44 is supported by the camshaft 1 in a manner that relative rotation is possible. That is, the driving rotor 40 is supported in the radial direction by the journal portion 1*a* from a radial inner side, and is rotated with a crankshaft. The driving rotor 40 is not supported by the chamfering portion 1*c*.

Figure 4:
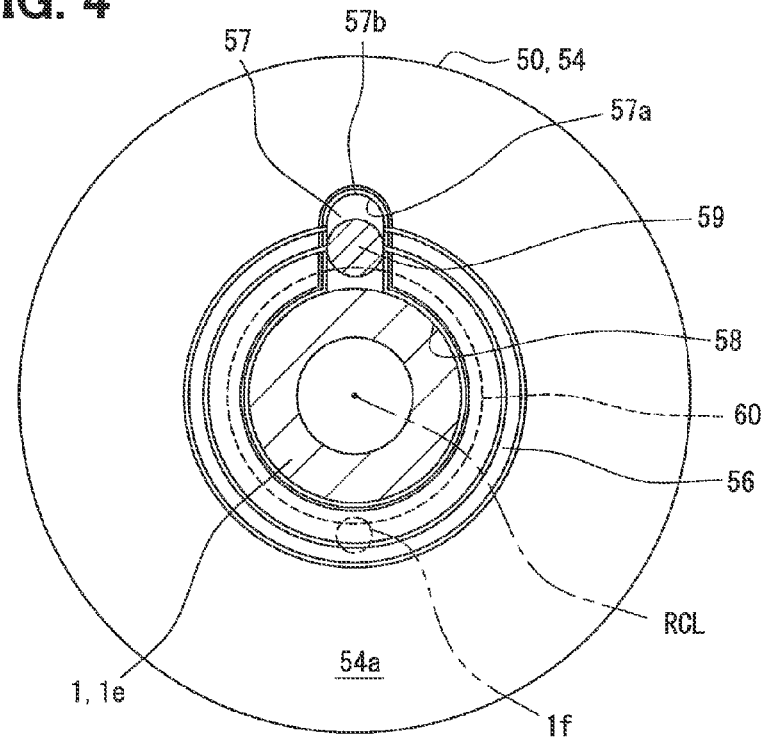
FIG. 4 is a sectional view taken along a line IV-IV of FIG. 1.

As shown in FIGS. 1 and 4, the driven rotor 50 has a contact surface 54*a*, an opposing surface 54*b*, a fastening component 55, an annular port 56, and a feed port 57, at the fastening part 54. The contact surface 54*a* is in contact with the tip end 1*d* of the chamfering portion 1*c* of the camshaft 1. The opposing surface 54*b* is a surface of the fastening part 54 opposite from the contact surface 54*a*, and opposes the end surface of the planet carrier 60 in the axial direction.

The fastening part 54 has a through hole 58 passing through the driven rotor 50 in the axial direction, and the fastening component 55 passes through the through hole 58 having a cylindrical shape. The fastening component 55 is a screw component having an axial part 55*a* and a head 55*b*. The axial part 55*a* passes through the through hole 58 through the projection end 1*e* of the camshaft 1, and is engaged with the camshaft 1. The fastening part 54 is supported between the head 55*b* and the camshaft 1, and is fastened to the camshaft 1.

The annular port 56 is continuously extended in the rotational direction of the driven rotor 50, and has a circular based groove shape. The annular port 56 is opened in the contact surface 54*a* of the fastening part 54. In this embodiment, the outer circumference part of the annular port 56 is located on the radially inner side of the tip end 1*d* of the chamfering portion 1*c* and the outer circumference part 1*b* of the journal portion 1*a* in the camshaft 1 having the same axis as the annular port 56. The inner periphery part of the annular port 56 is located on the radially inner side of the inner periphery part of the through hole 58 to which the projection end 1*e* of the camshaft 1 is fitted in the fastening part 54 having the same axis as the annular port 56.

Figure 6:
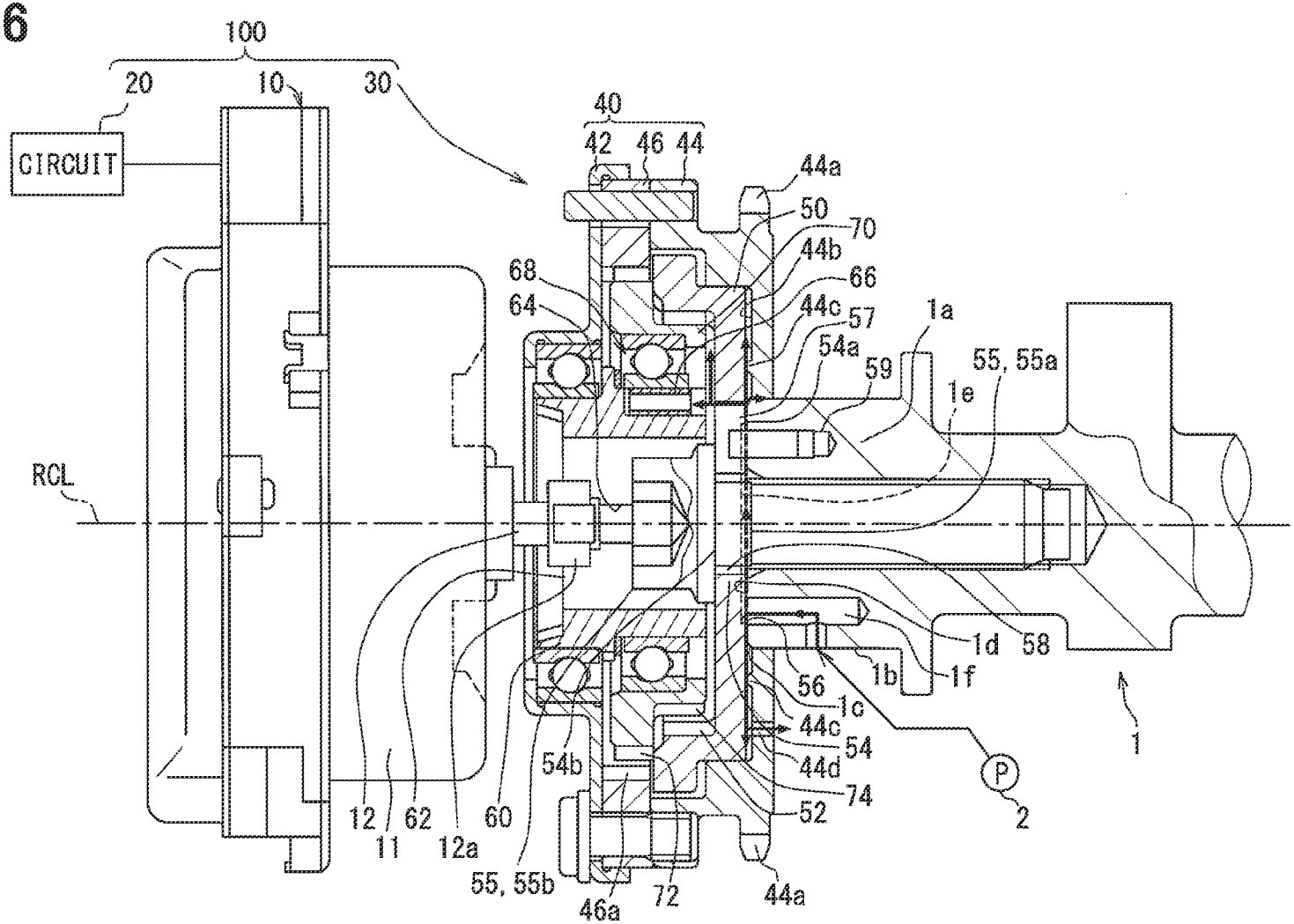
FIG. 6 is a view explaining a flow of lubricant in FIG. 1.

The annular port 56 communicates with a through hole 1*f* of the camshaft 1 at one place in the extending direction. The through hole 1*f* sends lubricating oil as a lubricant, and is connected to the pump 2 discharging lubricating oil in response to operation of the internal combustion engine. The lubricating oil breathed out from the pump 2 is supplied to the annular port 56 through the through hole 1*f*, as shown in FIG. 6. The lubricating oil supplied to the annular port 56 is led between the driving rotor 40 and the outer circumference part 1*b* of the camshaft 1 by passing through between the tip end 1*d* of the camshaft 1 and the contact surfaces 54*a*. Therefore, lubricating oil can be guided around the all circumferences of the rotors 40 and 50 spreading outward in the radial direction in addition to the area between the driving rotor 40 and the outer circumference part 1*b* of the camshaft 1.

The fastening part 54 has the feed port 57 opened in the inner circumference surface of the through hole 58, and a bottom is defined on the radially outer side of the opening in the shape of a based groove. The feed port 57 passes through the driven rotor 50 in the axial direction, between the contact surface 54*a* and the opposing surface 54*b*, and is opened in both of the contact surface 54*a* and the opposing surface 54*b*. A positioning component 59 with a pin shape is inserted into the feed port 57 to fit and fix to the camshaft 1, on the radially outer side of the through hole 58 in which the fastening component 55 passes in the fastening part 54, such that the driven rotor 50 is positioned relative to the camshaft 1 in the circumferential direction. That is, the feed port 57 works as an insertion hole of the positioning component 59 when the positioning component 59 is inserted.

Figure 5:
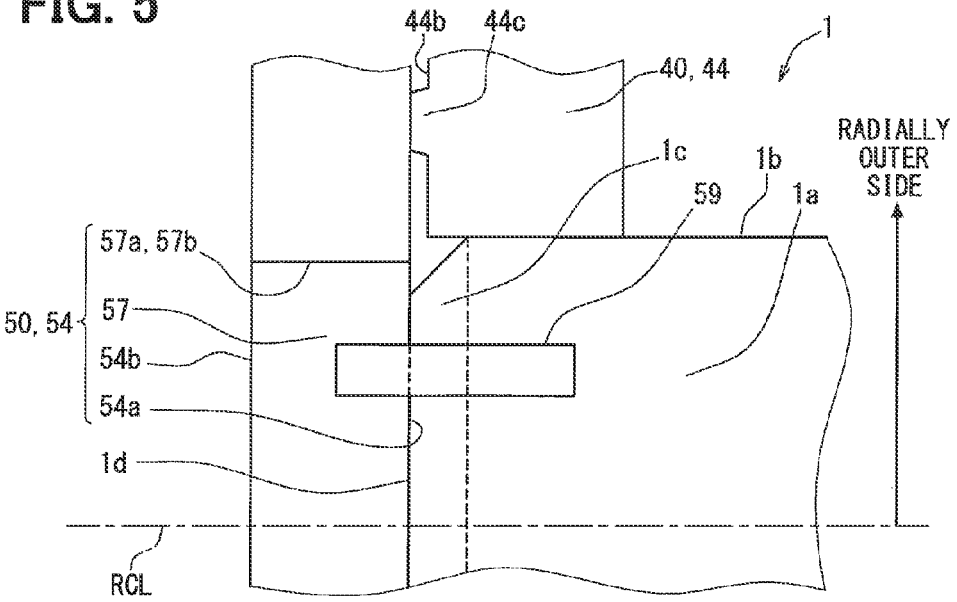
FIG. 5 is a schematic enlarged view illustrating a part of FIG. 1.

As shown in FIGS. 1, 4, and 5, a distance between the deepest point 57*b* of the outer edge part 57*a* of the feed port 57 and the rotation central line RCL of the rotors 40 and 50 in the radial direction is larger than a distance between the rotation central line RCL and the maximum eccentric point of the support part 66 of the planet carrier 60 relative to the rotors 40 and 50. Moreover, the deepest point 57*b* of the outer edge part 57*a* is located on the radially outer side of the tip end 1*d* of the chamfering portion 1*c*, and is located on the radially inner side of the outer circumference part 1*b* of the journal portion 1*a* over the area from the contact surface 54*a* to the opposing surface 54*b*. In addition, a comparison with the tip end 1*d* in the radial direction is performed with a reference where the most radially outer side position of the tip end 1*d* having the circle shape (namely, the connection place connected with the chamfering portion).

In the fastening part 54, the feed port 57 communicates to one place of the annular port 56 extended in the rotational direction of the driven rotor 50. The communication part of the feed port 57 communicating with the annular port 56 is set to be deviated (shifted) in the rotational direction of the driven rotor 50 relative to the communication part of the through hole 1*f*, that is, relative to the supply part of lubricating oil from the through hole 1*f*. In this embodiment, the communication part is set at a position shifted around the rotation central line RCL by 180 degrees.

Accordingly, as shown in FIG. 6, the lubricating oil flows into the feed port 57 from the annular port 56. The lubricating oil which flowed into the feed port 57 is introduced from the feed port 57 into each part inside of the driving rotor 40.

At this time, as shown in FIG. 6, lubricating oil can be certainly guided between the connection part 62 opposite from the camshaft 1 and the control shaft 12 on the radially inner side thereof, and toward the rolling bearing 68 supported by the radially outer side of the support part 66 and the planet gear 70. Moreover, as shown in FIG. 6, the lubricating oil guided toward the planet gear 70 can be guided to an area between the gear parts 52 and 74 on a side adjacent to the feed port 57 and further guided to an area between the gear parts 46*a* and 72 having the diameter larger than the gears parts 52 and 74. In this embodiment, the outer edge part 57*a* of the feed port 57 extends to an area between the tip end 1*d* and the outer circumference part 1*b*, the lubricating oil flowing into the feed port 57 can be guided to the radially outer side of the contact surface 54*a* and the interface of the journal portion 1*a*.

The driving rotor 40 has the thrust receptacle part 44*c* projected toward the contact surface 54*a* from the plane-shaped inner wall surface 44*b* of the sprocket component 44 to receive the driven rotor 50 in the axial direction. The thrust receptacle part 44*c* is arranged on the radially outer side of the outer edge part 57*a*. That is, the feed port 57 and the thrust receptacle part 44*c* are arranged not to be in contact with each other. The thrust receptacle part 44*c* is coaxially in contact with the contact surface 54*a*, thereby the contact surface 54*a* is supported by the thrust receptacle part 44*c*.

Furthermore, in this embodiment, the sprocket component 44 of the driving rotor 40 has a pressure regulation hole 44*d* which releases the pressure of the lubricant between the contact surface 54*a* of the driven rotor 50 and the inner wall surface 44*b* of the driving rotor 40, on the radially outer side of the feed port 57. In this embodiment, the pressure regulation hole 44*d* is located on the radially outer side of the thrust receptacle part 44*c*.

Advantages of the first embodiment are explained below.

According to the first embodiment, lubricating oil as a lubricant supplied from the camshaft 1 is introduced into the driving rotor 40 from the feed port 57. Since the outer edge part 57*a* of the feed port 57 in the radial direction is located on the radially outer side of the tip end 1*d* of the chamfering portion 1*c* at least, lubricating oil easily and smoothly lubricates the contact surface 54*a* and the interface of the journal portion 1*a*. Moreover, since the outer edge part 57*a* of the feed port 57 in the radial direction is located on the radially inner side of the outer circumference part 1*b* of the journal portion 1*a*, lubricating oil further easily infiltrates to the interface of the journal portion 1*a* by centrifugal force. Thus, lubricating oil can easily lubricate various parts in the valve timing controller 100.

According to the first embodiment, the driving rotor 40 has the thrust receptacle part 44*c* projected toward the contact surface 54*a* to receive the driven rotor 50 in the axial direction, and the outer edge part 57*a* on the contact surface 54*a* is located on the radially inner side of the thrust receptacle part 44*c*. Accordingly, an oil film is stably formed between the driven rotor 50 and the driving rotor 40, because the oil film as a liquid film formed from the feed port 57 between the driven rotor 50 and the driving rotor 40 is restricted from being cut by the edge. Thus, the damaging can be controlled.

According to the first embodiment, the driving rotor 40 has the pressure regulation hole 44*d* to release the pressure of lubricating oil between the driven rotor 50 and the driving rotor 40 on the radially outer side of the feed port 57. Therefore, the driving rotor 40 is restricted from displacing relative to the driven rotor 50 with the pressure of lubricating oil between the driven rotor 50 and the driving rotor 40. As a result, the planet gear 70 can smoothly move.

According to the first embodiment, the valve timing controller further includes a positioning component 59 which positions the driven rotor 50 relative to the camshaft 1, and the positioning component 59 is to be inserted to the feed port 57 as an insertion slot. Therefore, the feed port 57 can be easily formed by using the insertion slot required for positioning as the feed port 57.

Second Embodiment

Figure 7:
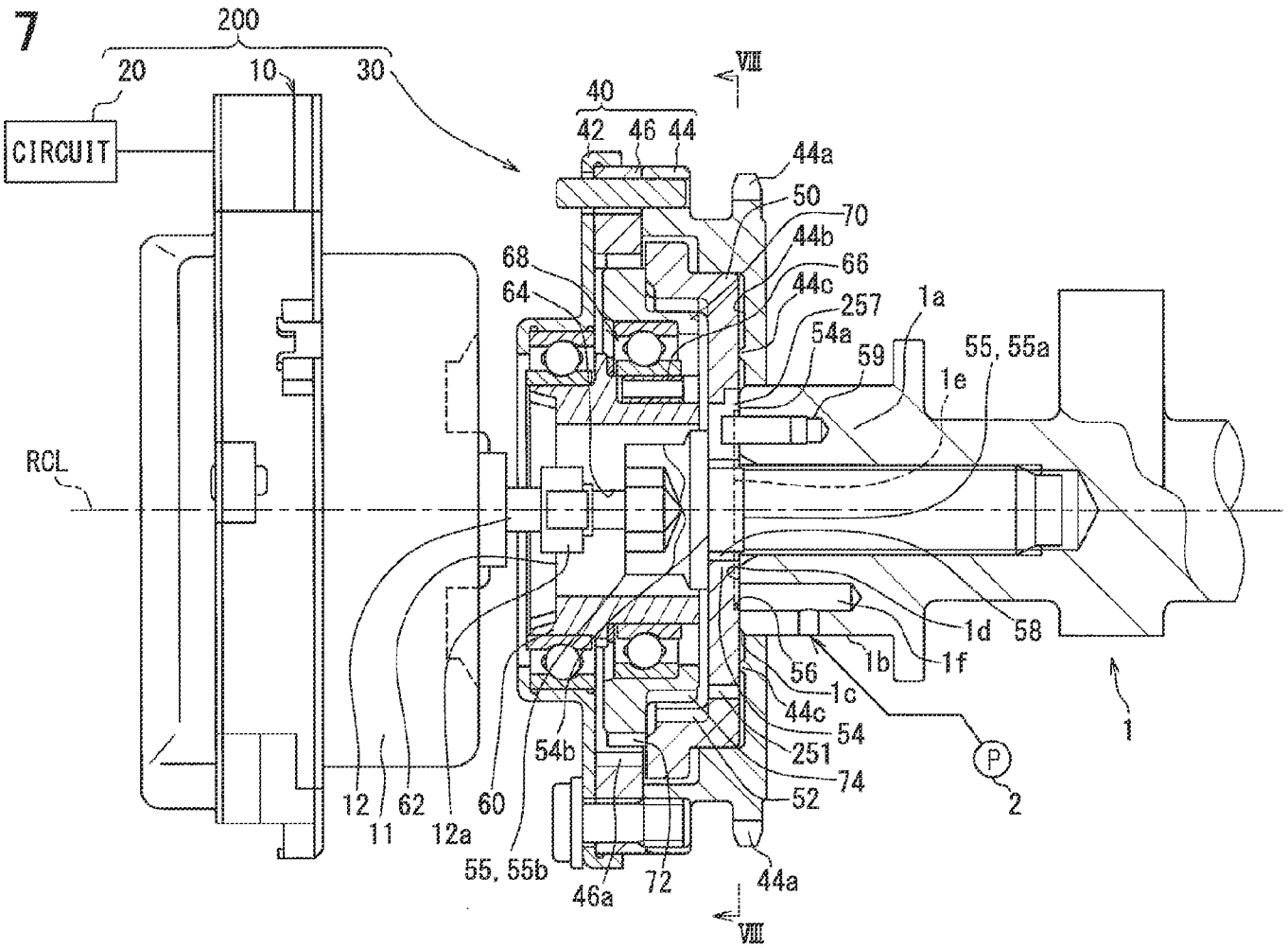
FIG. 7 is a schematic view illustrating a valve timing controller according to a second embodiment.
Figure 8:
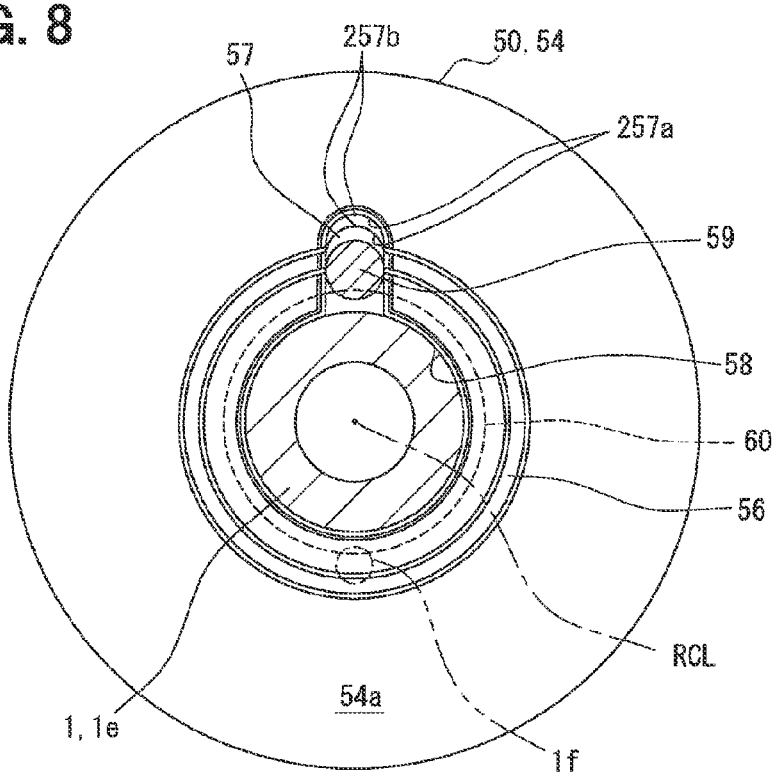
FIG. 8 is a sectional view taken along a line VIII-VIII of FIG. 7.
Figure 9:
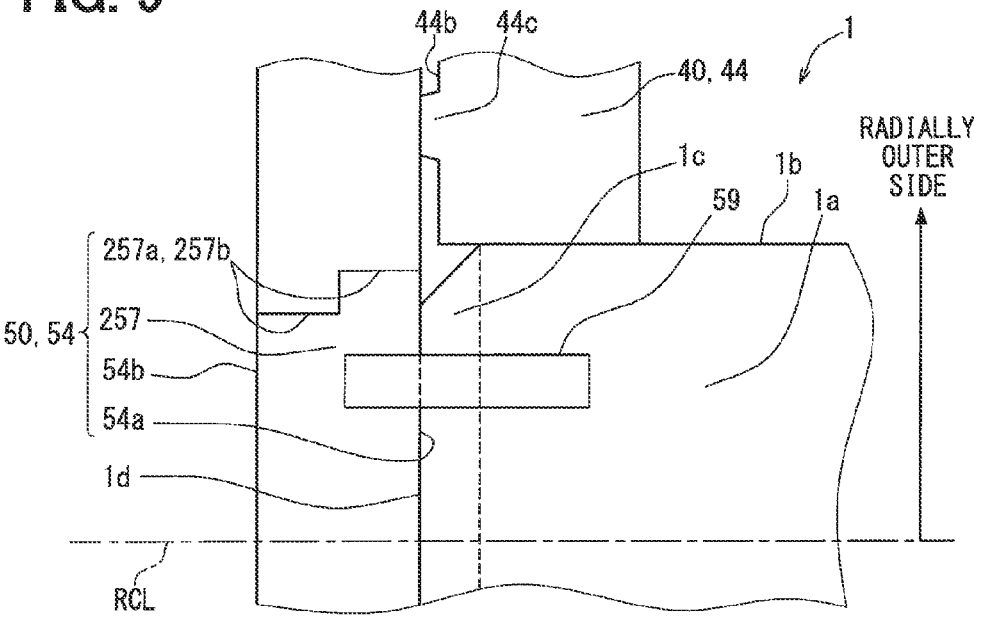
FIG. 9 is a schematic enlarged view illustrating a part of FIG. 7.

As shown in FIGS. 7-9, a second embodiment is a modification of the first embodiment. The second embodiment is described focusing on a different point from the first embodiment.

In the second embodiment, the outer edge part 257*a* of the feed port 257 in the radial direction is formed so that the diameter decreases as extending away from the contact surface 54*a* in contact with the camshaft 1. In detail, the outer edge part 257*a* has one-step level difference as extending away from the contact surface 54*a* in contact with the camshaft 1.

The deepest point 257*b* of the outer edge part 257*a* of the feed port 257, that is opposite from the contact surface 54*a* (namely, adjacent to the opposing surface 54*b*) is arranged on the radially inner side of the outer circumference part 1*b* of the journal portion 1*a*. Moreover, in this embodiment, the deepest point 257*b* of the outer edge part 257*a* opposite from the contact surface 54*a* is located on the radially inner side of the outer circumference part 1*b* of the journal portion 1*a*, and is arranged on the radially inner side of the tip end 1*d* of the chamfering portion 1*c*.

On the other hand, the deepest point 257*b* of the outer edge part 257*a* adjacent to the contact surface 54*a* is arranged on the radially outer side of the tip end 1*d* of the chamfering portion 1*c*. Moreover, in this embodiment, the deepest point 257*b* of the outer edge part 257*a* adjacent to the contact surface 54*a* is arranged on the radially outer side of the tip end 1*d* of the chamfering portion 1*c*, and is arranged on the radially inner side of the outer circumference part 1*b* of the journal portion 1*a*. Furthermore, in this embodiment, the outer edge part 257*a* adjacent to the contact surface 54*a* is arranged on the radially inner side of the thrust receptacle part 44*c*. That is, the feed port 257 and the thrust receptacle part 44*c* are arranged not to contact with each other.

As shown in FIG. 7, the driven rotor 50 has the pressure regulation hole 251 which releases the pressure of lubricating oil as a lubricant between the contact surface 54*a* of the driven rotor 50 and the inner wall surface 44*b* of the driving rotor 40, on the radially outer side of the feed port 257. The pressure regulation hole 251 is arranged on the radially outer side of the thrust receptacle part 44*c*.

According to the second embodiment, lubricating oil as a lubricant supplied from the camshaft 1 is introduced into the driving rotor 40 from the feed port 257. Since the outer edge part 257*a* of the feed port 257 opposite from the contact surface 54*a* of the camshaft 1 is arranged on the radially inner side of the outer circumference part 1*b* of the journal portion 1*a* at least, lubricant easily infiltrates into the interface of the journal portion 1*a* by centrifugal force. Since the outer edge part 257*a* adjacent to the contact surface 54*a* is arranged on the radially outer side of the tip end 1*d* of the chamfering portion 1*c*, lubricating oil easily and smoothly infiltrates into the contact surface 54*a* and interface of the journal portion 1*a*. Thus, the valve timing controller 200 can be offered in which lubricating oil easily lubricates various parts.

According to the second embodiment, the outer edge part 257*a* on the opposite side is arranged on the radially inner side of the outer circumference part 1*b* of the journal portion 1*a*, and is arranged on the radially inner side of the tip end 1*d* of the chamfering portion 1*c*. Accordingly, lubricating oil can be made to infiltrate into various parts by centrifugal force from the radially inner side.

According to the second embodiment, the outer edge part 257*a* adjacent to the contact surface 54*a* of the camshaft 1 is arranged on the radially outer side of the tip end 1*d* of the chamfering portion 1*c*, and is arranged on the radially inner side of the outer circumference part 1*b* of the journal portion 1*a*. Accordingly, lubricating oil infiltrates into the interface of the journal portion 1*a* more easily by centrifugal force from the outer edge part 257*a* adjacent to the contact surface 54*a* of the camshaft 1.

According to the second embodiment, the diameter of the feed port 257 is decreased at the outer edge part 257*a* stepwise extending away from the contact surface 54*a*. Accordingly, the step produces a liquid pool at the feed port 257, and lubricating oil easily infiltrates into the interface of the journal portion 1*a* with centrifugal force from the liquid pool.

According to the second embodiment, the driven rotor 50 has the pressure regulation hole 251 releasing the pressure of lubricating oil between the driven rotor 50 and the driving rotor 40 on the radially outer side of the feed port 257. Accordingly, the driving rotor 40 is restricted from being displaced relative to the driven rotor 50 due to the pressure of lubricating oil between the driven rotor 50 and the driving rotor 40. As a result, motion of the planet gear 70 is restricted from being affected.

The advantage of the first embodiment is also acquired by the composition which is common between the first embodiment and the second embodiment.

Other Embodiment

As a first modification of the first and second embodiments, the feed port 57 may be established at two or more places.

As a second modification of the second embodiment, the outer edge part 257*a* on the opposite side may be arranged on the radially inner side of the outer circumference part 1*b* of the journal portion 1*a*, and the outer edge part 257*a* adjacent to the contact surface 54*a* may be arranged on the radially outer side of the tip end 1*d* of the chamfering portion 1*c*.

Figure 10:
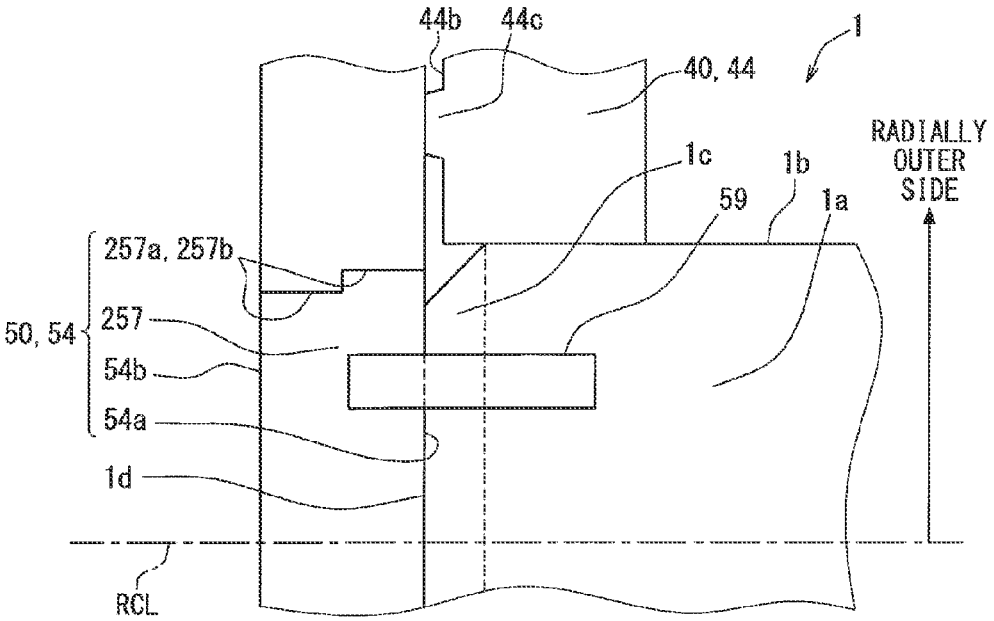
FIG. 10 is a schematic enlarged view illustrating a modification of the valve timing controller.

For example, as shown in FIG. 10, the outer edge part 257*a* on the opposite side may be arranged on the radially outer side of the tip end 1*d* of the chamfering portion 1*c*.

Figure 11:
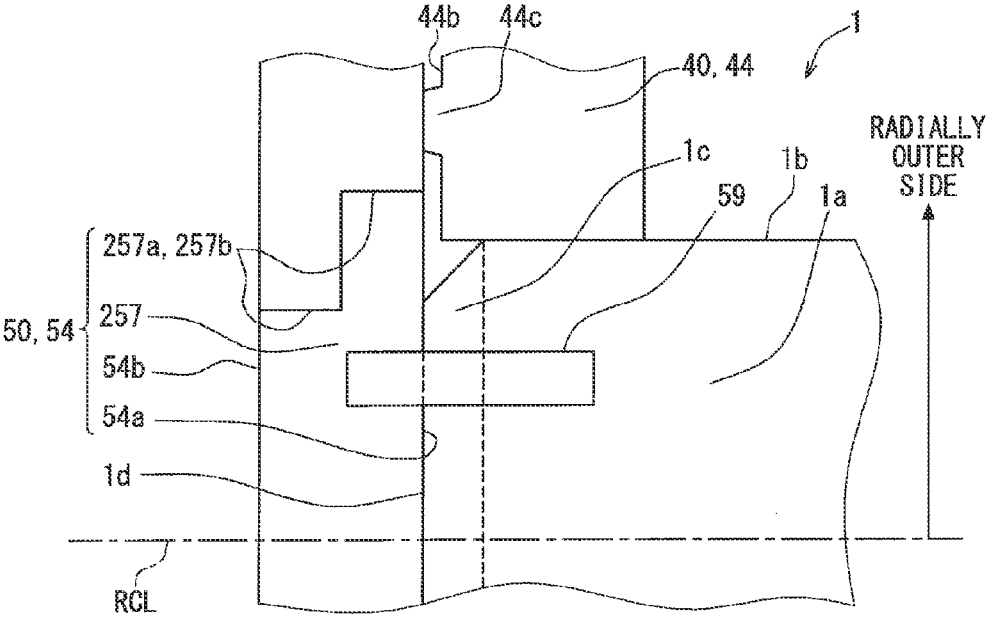
FIG. 11 is a schematic enlarged view illustrating a modification of the valve timing controller.

For example, as shown in FIG. 11, the outer edge part 257*a* adjacent to the contact surface 54*a* may be arranged on the radially outer side of the outer circumference part 1*b* of the journal portion 1*a*.

Figure 12:
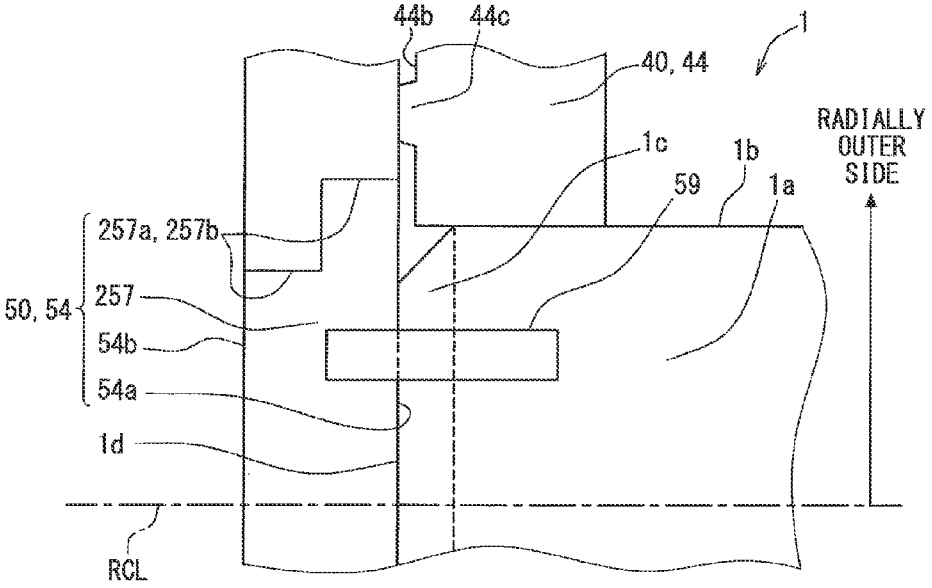
FIG. 12 is a schematic enlarged view illustrating a modification of the valve timing controller.

For example, as shown in FIG. 12, the outer edge part 257*a* on the opposite side may be arranged on the radially outer side of the tip end 1*d* of the chamfering portion 1*c*, and the outer edge part 257*a* adjacent to the contact surface 54*a* may be arranged on the radially outer side of the outer circumference part 1*b* of the journal portion 1*a*.

Figure 13:
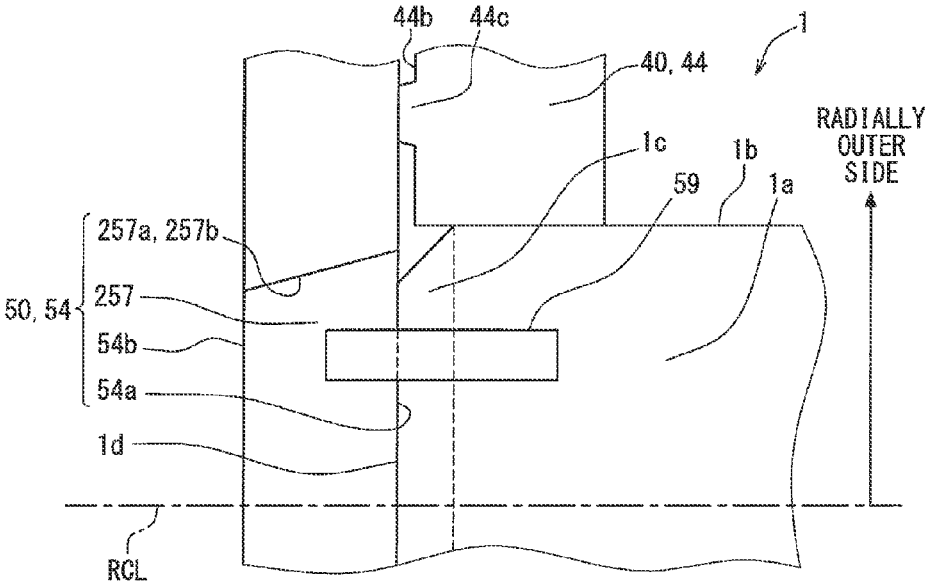
FIG. 13 is a schematic enlarged view illustrating a modification of the valve timing controller.

As a third modification of the second embodiment, as shown in FIG. 13, the diameter of the outer edge part 257*a* of the feed port 257 may be gradually decreased in the shape of a taper toward the opposite side from the contact surface 54*a* of the camshaft 1.

As a fourth modification of the first and second embodiments, the driving rotor 40 may not have the thrust receptacle part 44*c*.

As a fifth modification of the first and second embodiments, the driving rotor 40 may not have the pressure regulation hole 44*d*, and/or the driven rotor 50 may not have the pressure regulation hole 251.

The present disclosure is applicable to an equipment which adjusts valve timing of an exhaust valve or an equipment which adjusts valve timing of both an intake valve and an exhaust valve.

Such changes and modifications are to be understood as being within the scope of the present disclosure as defined by the appended claims.

What is claimed is:

1. A valve timing controller for an internal combustion engine having a camshaft with a journal portion and a chamfering portion, a diameter of the chamfering portion decreasing as extending from the journal portion toward a tip end of the camshaft, the valve timing controller controlling valve timing of a valve opened and closed by the camshaft using a torque transferred from a crankshaft, the valve timing controller comprising:

a driving rotor supported by the journal portion from a radially inner side to rotate with the crankshaft;

a driven rotor rotating with the camshaft inside of the driving rotor; and a planet gear engaged with the driving rotor and the driven rotor to control a rotation phase of the driven rotor relative to the driving rotor by carrying out planet movement, wherein the driven rotor has a contact surface in contact with a tip end of the chamfering portion, and a feed port passing through the driven rotor in an axial direction to introduce lubricant supplied from the camshaft into the driving rotor, the feed port has an outer edge part located on a radially outer side, and the outer edge part, on a side adjacent to the contact surface, is located on a radially outer side of the tip end of the chamfering portion and is located on a radially inner side of an outer circumference part of the journal portion.

2. The valve timing controller according to claim 1, wherein the driving rotor has a thrust receptacle part projected toward the contact surface to receive the driven rotor in an axial direction, and the outer edge part, on the contact surface, is located on a radially inner side of the thrust receptacle part.

3. The valve timing controller according to claim 1, wherein the driving rotor has a pressure regulation hole on a radially outer side of the feed port to release pressure of the lubricant between the driven rotor and the driving rotor.

4. The valve timing controller according to claim 1, further comprising:

a positioning component which positions the driven rotor relative to the camshaft, wherein the positioning component is to be inserted to the feed port corresponding to an insertion slot.

5. A valve timing controller for an internal combustion engine having a camshaft with a journal portion and a chamfering portion, a diameter of the chamfering portion decreasing as extending from the journal portion toward a tip end of the camshaft, the valve timing controller controlling valve timing of a valve opened and closed by the camshaft using a torque transferred from a crankshaft, the valve timing controller comprising:

a driving rotor supported by the journal portion from a radially inner side to rotate with the crankshaft;

a driven rotor rotating with the camshaft inside of the driving rotor; and a planet gear engaged with the driving rotor and the driven rotor to control a rotation phase of the driven rotor relative to the driving rotor by carrying out planet movement, wherein the driven rotor has a contact surface in contact with the tip end of the camshaft, and a feed port passing through the driven rotor in an axial direction to introduce lubricant supplied from the camshaft into the driving rotor, the feed port has an outer edge part located on a radially outer side, a diameter of the outer edge part is smaller on an opposite side opposite from the contact surface than that on the contact surface, the outer edge part, on the opposite side, is located on a radially inner side of an outer circumference part of the journal portion, and the outer edge part, on the contact surface, is located on a radially outer side of a tip end of the chamfering portion.

6. The valve timing controller according to claim 5, wherein the outer edge part, on the opposite side, is located on the radially inner side of the outer circumference part of the journal portion and is located on a radially inner side of the tip end of the chamfering portion.

7. The valve timing controller according to claim 5, wherein the outer edge part, on the contact surface, is located between the tip end of the chamfering portion and the outer circumference part of the journal portion in the radial direction.

8. The valve timing controller according to claim 5, wherein a diameter of the outer edge part of the feed port is decreased stepwise as extending from the contact surface to the opposite side.

9. The valve timing controller according to claim 5, wherein the driven rotor has a pressure regulation hole on a radially outer side of the feed port to release pressure of the lubricant between the driven rotor and the driving rotor.

* * * * *